US006196166B1

(12) United States Patent
Yonezawa

(10) Patent No.: US 6,196,166 B1
(45) Date of Patent: Mar. 6, 2001

(54) ENGINE COOLANT MANIFOLD

(75) Inventor: Minoru Yonezawa, Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/426,337

(22) Filed: Oct. 25, 1999

(30) Foreign Application Priority Data

Nov. 11, 1998 (JP) ..... 10-320156

(51) Int. Cl.[7] ..... F02F 1/36
(52) U.S. Cl. ..... 123/41.01; 123/41.29
(58) Field of Search ..... 123/41.72, 41.29, 123/41.82 R, 90.27, 195 C, 41.01

(56) References Cited

U.S. PATENT DOCUMENTS 4,284,037 * 8/1981 Kasting et al. ..... 123/41.82 R
4,953,525 * 9/1990 Sakurai et al. ..... 123/41.28
5,035,207 * 7/1991 Sakurai et al. ..... 123/41.1
5,074,255 * 12/1991 Ebesu et al. ..... 123/41.74

* cited by examiner

*Primary Examiner*—Willis R. Wolfe
*Assistant Examiner*—Hyder Ali
(74) *Attorney, Agent, or Firm*—Knobbe, Martens, Olson & Bear LLP

(57) ABSTRACT

An internal combustion engine cam drive arrangement and coolant manifold. The engine comprises an engine body that is formed with an coolant opening that is circumscribed by a flexible transmitter that drives cam shafts from the engine crankshaft. A coolant manifold communicates with this opening and overlies in part the flexible transmitter. At least a major part of the remaining portion of the flexible transmitter is covered by a timing cover. The timing cover and the coolant manifold each may be removed from the engine body independently of the other.

9 Claims, 5 Drawing Sheets

ENGINE COOLANT MANIFOLD

BACKGROUND OF THE INVENTION

This invention relates to an internal combustion engine and more particularly to an improved coolant manifold for such engine.

As is well known, internal combustion engines generally comprise an engine body that defines one or more combustion chambers in which combustion occurs. The combustion chambers are defined by a movable element, such as a piston, that is connected to an output shaft, such as a crankshaft, by a suitable mechanism for providing a power output from the engine. A load may be either driven directly from this engine crankshaft or from an auxiliary shaft that is driven from the engine crankshaft.

Normally, at least an intake air charge is delivered to the combustion chambers of the engine through an induction system and the combustion products are discharged from the combustion chambers through an exhaust system. Some type of valving mechanism is employed for controlling the communication of the combustion chamber with the intake system and the exhaust system and this frequently involves a valve actuating shaft that is driven by the engine output shaft. Many times, the valve actuating shaft comprises one or more camshafts which operate poppet type valves through a suitable follower mechanism for controlling the communication.

Most conveniently, the drive for the valve operating shaft is located at one end of the engine and frequently employs a flexible transmitter such as a chain or belt. By positioning this valve actuating driving mechanism at one of the engine, servicing is facilitated.

In most applications, the engine is also watered cooled and hence, the engine body is formed with one or more cooling jackets which communicate with an external heat exchanger. This involves the provision of coolant inlet and outlet openings in the engine body for deliver and discharging the coolant from these cooling jackets.

Quite often, at least one of these passages is disposed at an end of the engine and many times at the same engine where the valve actuating shaft is driven. In fact, it is not uncommon for the flexible transmitter to circumscribe an area around this coolant opening.

It is desirable if the valve operating drive and particularly the flexible transmitter is covered by some form of cover. Thus, the conduitry for conveying coolant to or from the coolant opening in the engine body is also circumscribed by the flexible transmitter. This gives rise to certain problems both in connection with coolant sealing, containment of the flexible transmitter in a protected relationship and also servicing the various components.

Normally, the flexible transmitter is substantially or primarily enclosed by a belt or chain cover and the conduit for communicating the coolant with the engine cooling jacket passes through this cover. This means that the coolant must be drained and the flexible connections to the cooling system removed in order to facilitate servicing of the flexible transmitter. This obviously makes servicing more difficult.

Also, this type of arrangement, as should be readily apparent, requires sealing around not only the coolant passages but also the area surrounding them so as to prevent foreign materials from entering in the valve actuating shaft drive.

It is, therefore, a principal object of this invention to provide an improved coolant manifold arrangement for an engine that will cooperate with the flexible transmitter drive for the valve actuating shaft to permit coolant interchange without requiring removal of the coolant connections for servicing of the flexible transmitter.

It is a further object of this invention to provide an improved coolant manifold for an engine that is juxtaposed to the flexible transmitter drive of the engine and which, itself, functions at least in part as a cover for the flexible transmitter.

It is a further object of this invention to provide an improved flexible transmitter drive cover arrangement for an engine that is associated with the engine cooling system and which has a coolant manifold that covers part of the flexible transmitter and a drive cover that covers the remainder of the flexible transmitter so that either the coolant manifold and/or the drive cover can be removed independently of the other for servicing of the appropriate components.

SUMMARY OF THE INVENTION

This invention is adapted to be embodied in an internal combustion engine that is comprised of an engine body that defines a cylinder bore fore receiving a piston to define a combustion chamber and a crankcase in which a crankshaft driven by the piston rotates. A valve mechanism is provided for controlling the admission of at least an air charge into the combustion chamber and the discharge of exhaust gases therefrom. This valve mechanism includes at least one valve shaft that is rotatably journaled within the engine body. A timing drive including at least one flexible transmitter is provided for driving the valve shaft from the crankshaft and is disposed at one end of the engine. The engine body has a cooling jacket that includes at one flow opening formed in an outer portion of the engine body and which flow opening is circumscribed by the flexible transmitter. A coolant manifold is detachably connected to the engine body and has one end that is in communication with the flow opening and another portion which extends transversely across part of the flexible transmitter for providing a cover for it. A drive cover is independently connected to the engine body and encloses at least the major remaining portion of the flexible transmitter.

DETAILED DESCRIPTION OF THE PREFERRED EMBODIMENT OF THE INVENTION

Figure 1:
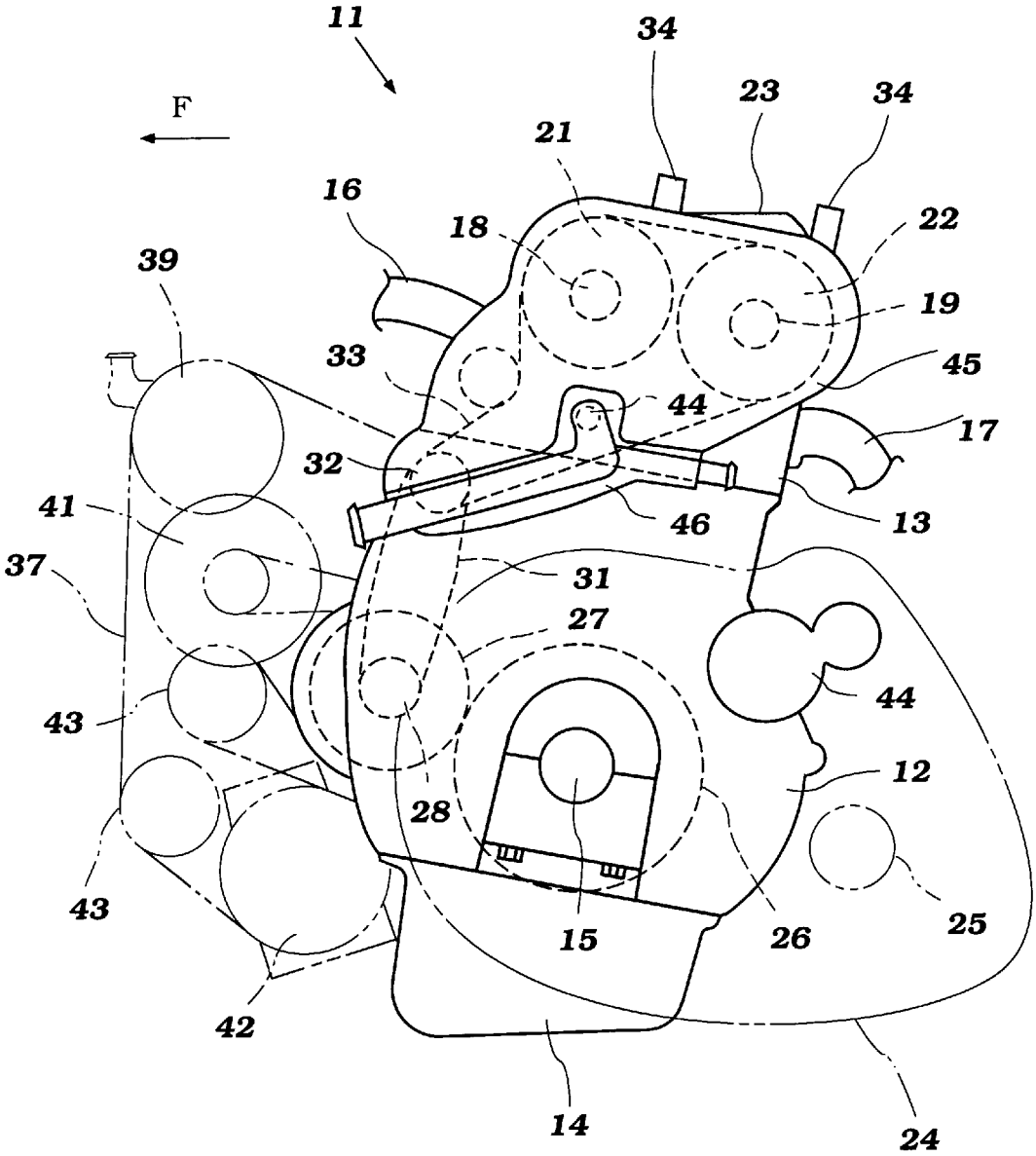
FIG. 1 is an end elevational view of an internal combustion engine constructed in accordance with an embodiment of the invention.
Figure 2:
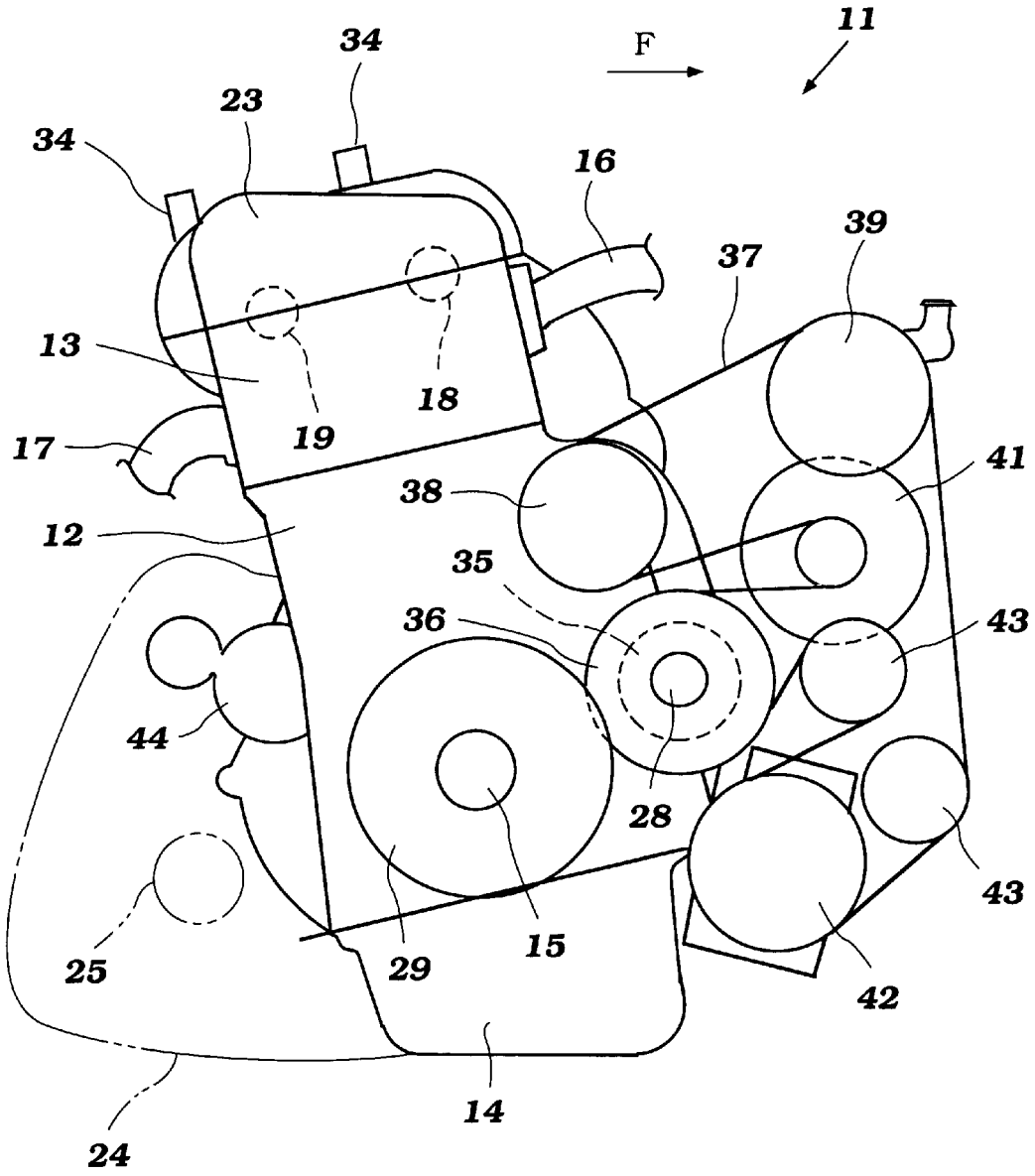
FIG. 2 is an end elevational view showing the opposite end of the engine from that depicted in FIG. 1.
Figure 3:
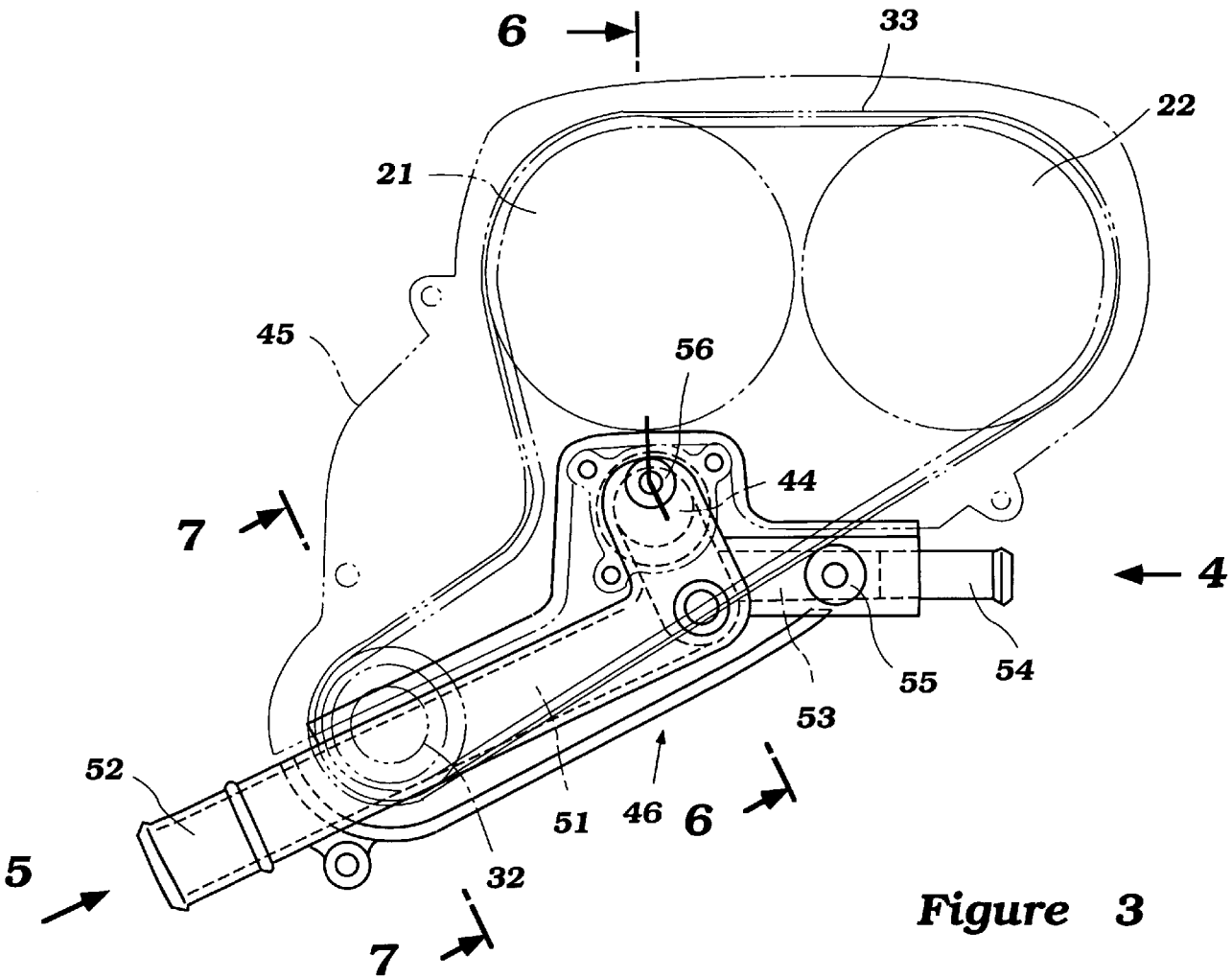
FIG. 3 is an enlarged view looking in the same direction as FIG. 1 and showing mainly the cylinder head configuration and the coolant manifold embodying the invention and cooperating with the cylinder head assembly. The coolant manifold is shown in solid lines and the remaining components are shown in phantom lines.
Figure 5:
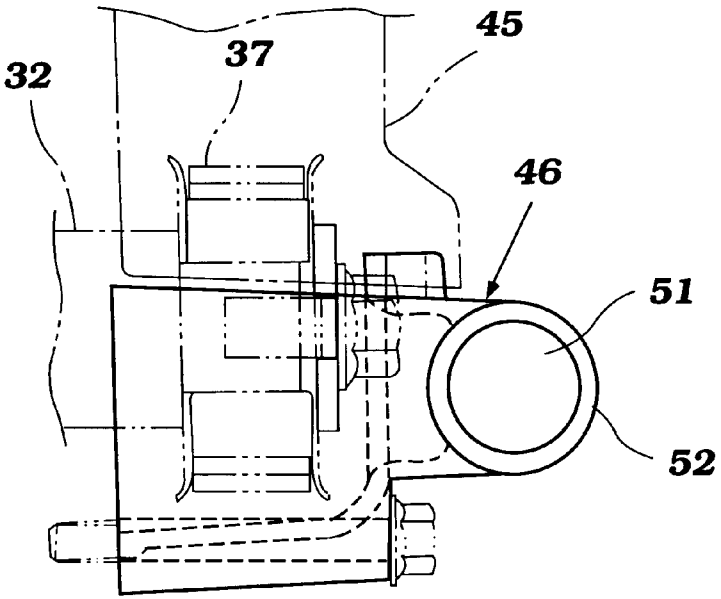
FIG. 5 is an enlarged view of the coolant manifold looking in the direction of the arrow 5 in FIG. 3.
Figure 4:
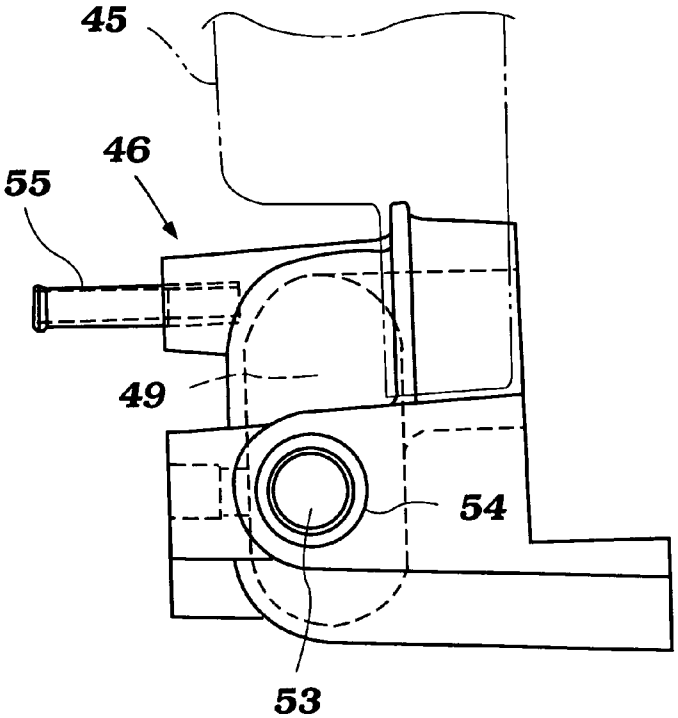
FIG. 4 is an enlarged view of the coolant manifold looking generally in the direction of the arrow 4 in FIG. 3.
Figure 7:
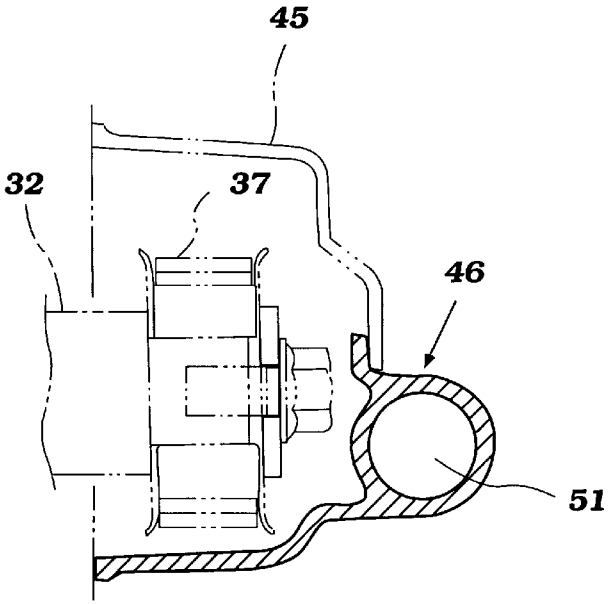
FIG. 7 is a cross-sectional taken along the lines 7—7 of FIG. 3 again showing the coolant manifold in solid lines and the associated engine components in phantom.
Figure 6:
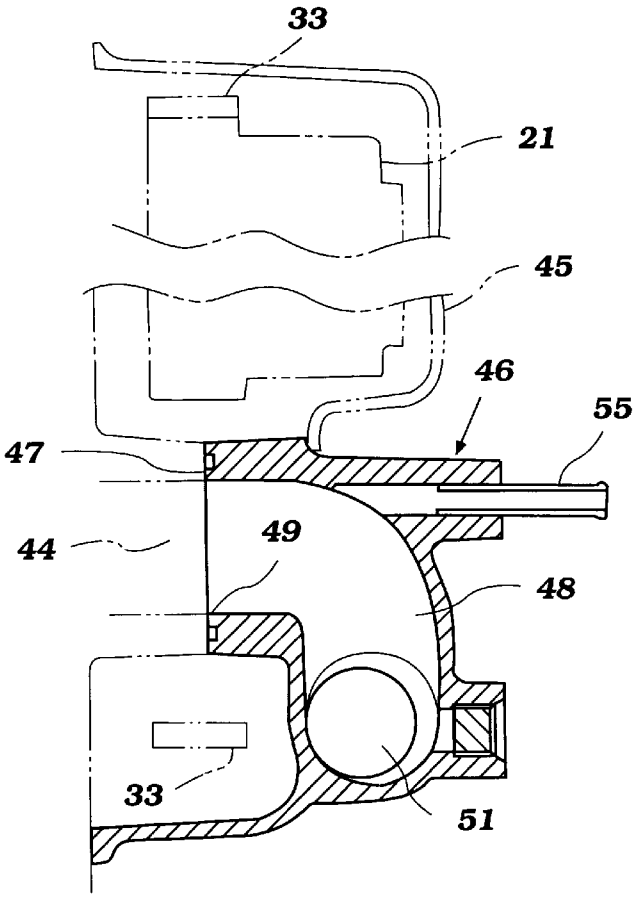
FIG. 6 is a cross-sectional view taken along the line 6—6 of FIG. 3 and shows the coolant manifold in solid lines and the associated components of the engine in phantom.

Referring now in detail to the drawings and initially primarily to FIGS. 1 and 2, an internal combustion engine constructed in accordance with an embodiment of the invention is indicated generally by the reference numeral 11. In the illustrated embodiment, the engine 11 is of the inline type and has a number of inline cylinders. The engine 11 is particularly adapted for use in powering the motor vehicle wherein the engine 11 is placed transversely in the engine compartment for driving the vehicle through a suitable final drive to be described later.

The construction of the engine permits this transverse mounting of the engine 11 with the direction of forward motion of the vehicle being indicated by the reference numeral F. Although such an orientation and such a driving application is exemplary, it will be readily apparent to those skilled in the art the invention can be utilized with a wide variety of types of applications other than motor vehicles and also in motor vehicles applications where the engine 11 is not necessarily positioned transversely in the engine compartment of the vehicle.

Also, the particular number of cylinders and the orientation of them is not necessarily a critical feature of the invention. It will become readily apparent to those skilled in the art that the invention can be utilized with a wide variety of engine configurations.

The engine 11 is made up of an engine body that is comprised of three major external components. These comprise a cylinder block assembly 12, a cylinder head assembly 13 and a crankcase or oil pan member 14. The cylinder block assembly 12 forms one or more inline cylinder bores in which pistons reciprocate. Since the internal details of the engine form no part of the present invention, they are not illustrated. It will be readily apparent, however, how the invention can be employed with a wide variety of engine configurations, as already noted.

The aforenoted pistons reciprocate in the cylinder bores and are connected by connecting rods, which are also not shown, so as to drive a crankshaft 15. The crankshaft 15 rotates about a transversely disposed axis within a crankcase chamber formed by the oil pan 14 and a lower skirt or crank case forming portion of the cylinder block assembly 12.

The aforenoted pistons and their respective cylinder bores cooperate with recesses formed in the cylinder head 13 so as to form the combustion chambers of the engine. An intake charge is delivered to these combustion chambers through an intake manifold, indicated generally by the reference numeral 16. The delivered intake charge may comprise a pure air charge or an air/fuel charge depending upon the type of charge forming system employed for the engine. Since the charge forming system as well as the porting arrangement associated therewith, like other components which have not been described in detail, forms no part of the invention, it will not be described in further detail. It is believed that those skilled in the art will readily understand how the invention can be utilized with various types of induction and porting systems.

The charge which is delivered to the combustion chambers is fired in an appropriate manner and is then discharged through an exhaust system which includes an exhaust manifold 17 that is affixed to the cylinder head 13 on the side opposite to the intake manifold 16. Again, any suitable type of exhaust system and porting arrangement can be employed with the engine 11 including the exhaust manifold 17.

Intake and exhaust valves are mounted in the cylinder head assembly 13 for controlling the intake and exhaust flow in a generally known manner and are operated by means of a valve actuating mechanism which is comprised of an intake cam shaft 18 and an exhaust cam shaft 19. These cam shafts 18 and 19 are journalled appropriately in the cylinder head assembly 13 and are driven at one half crankshaft speed by a suitable timing drive, to be described shortly.

This timing drive includes a pair of variable valve timing mechanisms, indicated generally by the reference numerals 21 and 22 which may be of any known types so as to vary the phase angle between the intake and exhaust cam shafts 18 and 19 and the engine crankshaft 15. These variable valve timing mechanisms 21 and 22 are operated in a manner which will be described generally shortly.

Finally, the valve actuating mechanism including some of those components already described is covered by means of a cam cover 23 that is affixed to and forms a part of the cylinder head assembly 13 in a suitable member.

The associated vehicle is driven from the engine crankshaft 15 or another output shaft thereof through a transmission which is shown only in phantom and indicated generally by the reference numeral 24. This transmission 24 includes an output shaft 25 which is driven through a suitable transmission which may include a change speed mechanism of either a manual or an automatic type. Again, this component is not an important part of the invention and, for that reason, has not been illustrated in detail.

The mechanism for driving the cam shafts 18 and 19 including the variable valve timing mechanisms 21 and 22 will now be described by primary reference to FIGS. 1 and 2. The crankshaft 15 has a timing gear 26 affixed to it at an appropriate position along its length and which may be disposed adjacent one end of the engine such as the end shown in FIG. 1. However, this timing gear 26 need not be disposed at the absolute end of the crankshaft 15 but may be disposed inwardly at one or more throws thereof so as to maintain a short overall length for the engine.

This timing gear 26 is enmeshed with a driven timing gear 27 which drives a balancer shaft 28. The balancer shaft 28 can contain one or more balancing masses for partially balancing the crankshaft 15. In addition, a torsional damper 29 is affixed to the one end of the crankshaft 15 specifically the end shown in FIG. 2.

In addition to providing a balancer action, the balancer shaft 28 also includes a timing sprocket 30 which drives a first flexible timing drive 31 which may comprise either a toothed belt or a chain. This drives a cam shaft driving shaft 32 which is journaled at an upper portion of the cylinder block 12 at one side thereof in a suitable manner.

The cam driving shaft 32 has a sprocket or toothed member fixed to an appropriate position adjacent one end of the engine (the end shown in FIG. 1) so as to drive a second flexible transmitter drive 33 which comprise either a chain or toothed belt. This flexible transmitter 33 is engaged with appropriate sprockets carried by the variable valve timing mechanisms 21 and 22 so as to drive the cam shafts 18 and 19 at one half of the speed of the crankshaft 15.

It should be noted that the speed reduction can be provided in several and different stages between the crankshaft 15, the balancer shaft 28, the cam driving shaft 32 and the variable valve timing mechanisms 21 and 22. Because of this multistage stepdown, the individual sprockets or gears can be maintained with a relatively small diameter to permit a compact engine construction.

The variable valve timing mechanisms 21 and 22 may, as have been noted, be of any known type and preferably hydraulically actuated so as to vary the valve timing in accordance with any desired control strategy. Control valves 34 are mounted in the cylinder head assembly 13 and specifically adjacent the timing drive for effecting this control through any suitable mechanism.

As may be best seen in FIG. 2, the balancer shaft 28 extends through one end of the engine and protrudes at the end shown in FIG. 2. At this point, the balancer shaft 28 may drive an oil pump 35 for supplying lubricant from a suitable lubricant system including the oil pan 14 to the various components of the engine as well as the VVT control valves 34 for engine operation. Also affixed to the balancer shaft 28 at this end of the engine, is an accessory drive pulley 36.

This accessory drive pulley 36 drives a flexible transmitter 37 for driving a plurality of engine accessories. These may include, by way of example, a coolant pump 38 for circulating liquid coolant through the cooling jackets of the engine 11, as will be described in part in more detail later. In addition, there are driven a further oil pump 39, an alternator 41, and an air conditioner pulley 42. In order to provide this serpentine drive for the accessories, there are also provided idler pulleys 43 one of which may be adjustable so as to adjust the tension in the drive belt 37.

A starter motor 40 is mounted on a side of the cylinder block and cooperates with a suitable starter gear formed on the crankshaft 15 or a flywheel associated therewith including the damper 29 for electrical starting of the engine.

Referring now primarily to FIGS. 2–7, the association of the timing drive belt of chain 33 and the engine cooling system and particularly the cooperation with a coolant discharge opening 44 formed in the cylinder head 13 will be described. The face of the engine and specifically of the cylinder head 13 adjacent the flexible transmitter 33 is formed with the opening 44 via which coolant may be discharged from the engine body and specifically the cylinder block 12 and cylinder head 13 and cooling jackets thereof will be described.

It will be seen that this opening 44 lies in an area circumscribed by the flexible transmitter 33. Normally, this area would be covered by a timing driving cover which would completely cover the cylinder head 13 at this end of the engine and also possibly an upper portion of the cylinder block 12 including the drive pulley 32 that is driven by the flexible transmitter 31. In accordance with the invention, a cover 45 is provided which is affixed to the cylinder head 13 and valve cover 23 at this end of the engine and which covers basically the variable valve timing drives 21 and 22 and a major portion of the length of the flexible transmitter 33.

However, the area adjacent to that where the water outlet opening 44 is located is partially covered by a timing cover, indicated generally as 45, at this end of the engine. The timing cover 45 covers basically the variable valve timing drives 21 and 22 and a major portion of the length of the flexible transmitter 33. However, the area overlying the water outlet opening 44 is covered by a coolant manifold member, indicated generally by the reference numeral 46, and which has a face 47 that is directly engaged with the adjacent surface of the cylinder head 13.

A flow path 48 extends through this manifold member 46 from an inlet opening 49 that mates with the cylinder head outlet opening 44. This path 48 curves and then intersects a main manifold passage 51 which extends transversely outwardly beyond the cover 45 and also the cylinder block 12 so as to receive a hose (not shown) on a nipple portion 52 thereof for distributing the coolant back to the heat exchanger.

In addition, a bypass passageway 53 intersects the passage portion 48 and carries a nipple 54 that may extend to a further hose such as a heater hose or the like. A mounting boss 55 in this area mounts a device such as a temperature sensor or the like for providing an indicating of engine coolant temperature. Finally, an air bleed fitting 56 is provided which can receive a removable valve or cap so as to permit bleeding of the air from the cooling system.

The passage 51 is formed in an L-shape part 57 of the housing assembly 46 that cooperates with a cutout 58 formed in the cover 45 so that the two covers formed by the coolant manifold 46 and the timing belt cover 45 completely cover the flexible transmitter 33. However and as should be apparent from the figures, the transmitter 33 can be conveniently reached for servicing. Furthermore, the manifold 46 and the cover 45 can be removed independently of each other so that servicing is greatly facilitated from prior art constructions.

Of course, the foregoing description is that of a preferred embodiment of the invention, and various changes and modifications may be made without departing from the spirit and scope of the invention, as defined by the appended claims.

What is claimed is:

1. An internal combustion engine comprising an engine body defining a cylinder bore for receiving a piston to define a combustion chamber and a crankcase chamber in which crankshaft driven by said piston rotates, a valve mechanism for controlling the induction of at least an air charge into said combustion chamber and the discharge of exhaust gases therefrom, said valve mechanism including at least one valve shaft rotatably journaled by said engine body, a timing drive for driving said valve shaft from said crankshaft including at least one flexible transmitter disposed at one end of said engine, a coolant jacket formed in said engine body for cooling said engine body, a coolant opening formed in said one end of said engine body in an area circumscribed by said one flexible transmitter, a coolant mainfold affixed to said engine body and having a fluid passage formed therein communicating directly with said engine body coolant opening for circulating coolant, said coolant manifold overlying in part said one flexible transmitter, and a timing cover affixed to said engine body contiguous to said coolant manifold and covering a remaining portion of said one flexible transmitter, said coolant manifold and said timing cover each being removable from said engine body without removal of the other.

2. An internal combustion engine as set forth in claim 1, wherein the valve shaft comprises a cam shaft.

3. An internal combustion engine as set forth in claim 2, wherein the cam shaft is rotatably journaled in a cylinder head of the engine body.

4. An internal combustion engine as set forth in claim 1, wherein the timing driving includes an intermediate shaft journaled in the engine body at a position between the rotational axes of the crankshaft and the valve shaft and at one side thereof for driving said one flexible transmitter.

5. An internal combustion engine as set forth in claim 4, further including a further flexible transmitter for driving said intermediate shaft from said crankshaft.

6. An internal combustion engine as set forth in claim 5, wherein the further flexible transmitter lies on one side of the engine body.

7. An internal combustion engine as set forth in claim 6, wherein the valve shaft comprises a cam shaft and further including a second cam shaft also driven by the one flexible transmitter.

8. An internal combustion engine as set forth in claim 7, wherein the cam shafts are rotatably journaled in a cylinder head of the engine body and the coolant opening is formed in said cylinder head between said cam shafts and below them.

9. An internal combustion engine as set forth in claim 8, wherein the timing cover covers a pair of sprockets, each of which is interposed between the one flexible transmitter and a respective one of the cam shafts for transmitting the drive to said cam shafts.

* * * * *